US005134553A

United States Patent [19]

Hasegawa

[11] Patent Number: 5,134,553

[45] Date of Patent: Jul. 28, 1992

[54] ILLUMINATING DEVICE

[75] Inventor: Yoshihiro Hasegawa, Saitama, Japan

[73] Assignee: Toshiaki Nakagawa, Yokohama, Japan

[21] Appl. No.: 773,243

[22] Filed: Oct. 9, 1991

[30] Foreign Application Priority Data

Oct. 17, 1990 [JP] Japan ..... 2-108706[U]

[51] Int. Cl.[5] ..... F21S 3/00; F21V 13/10

[52] U.S. Cl. ..... 362/223; 362/225; 362/241; 362/297; 362/812; 40/564

[58] Field of Search ..... 362/225, 241, 260, 297, 362/346, 812, 223, 307, 311, 351, 240; 40/541, 564, 568, 569

[56] References Cited

U.S. PATENT DOCUMENTS

| | | | |
|---|---|---|---|
| 2,335,735 | 11/1943 | Campen | 362/225 |
| 4,388,675 | 6/1983 | Lewin | 362/346 |
| 4,747,027 | 5/1988 | Rieger | 362/297 |

FOREIGN PATENT DOCUMENTS

| | | | |
|---|---|---|---|
| 1076056 | 2/1960 | Fed. Rep. of Germany | 362/225 |

*Primary Examiner*—Richard R. Cole

*Attorney, Agent, or Firm*—Flynn, Thiel, Boutell & Tanis

[57] ABSTRACT

In an illuminating device, in which a plurality of straight tube type discharge lamps B are arranged in parallel with an interval and there is disposed a translucent sheet a for advertising display in front of a row of the lamps, a reflector C is arranged behind each of the lamps B. This reflector C comprises a first reflecting plate C1 protruding in a V-shape backward to left and right so as to reflect light emitted backward from the lamp obliquely forward to left and right and to illuminate a central region between adjacent lamps on the translucent sheet; a pair of second reflecting plates C2, each of which is contiguous to one end of the V-shaped first reflecting plate and reflects light emitted obliquely backward from the lamp so as to illuminate a wide region including the central region between adjacent lamps on the translucent sheet; and a pair of third reflecting plates C3, each of which is contiguous to an end of each second reflecting plates, which is not contiguous to the end of the V-shaped first reflecting plate, so as to reflect light emitted obliquely backward by the lamp and to illuminate a region including the central region between adjacent lamps on the translucent sheet.

18 Claims, 6 Drawing Sheets

ILLUMINATING DEVICE

FIELD OF THE INVENTION

The present invention relates to an illuminating device and in particular to an improvement of an illuminating device suitable for a large scale advertising board.

BACKGROUND OF THE INVENTION

Heretofore, as an illuminating device for an advertising board, a large scale illuminating device is used, which is so constructed that a number of straight tube type fluorescent lamps (50 to 60) are arranged parallelly to each other with a certain interval and an advertisement displaying translucent member (molded synthesized resin plate or synthesized resin sheet with cloth) is disposed in front of rows of the lamps. In particular, in the design of the illuminating device for a large scale advertising board there are problems as follows, concerning the interval of the lamps and the distance between the lamps and the displaying translucent member acting as an irradiated surface.

(1) If the lamps are brought close to the translucent member acting as the irradiated surface in order to increase brightness (brilliance), lamp image (difference in brilliance) takes place. Therefore uniform brilliance is kept by decreasing the interval of the lamps. In this case, the number of lamps increases.

(2) When the lamps are kept away from the irradiated surface, light and dark lines disappear, but brightness decreases. In this case the interval of the lamps can be increased.

(3) However, for an advertising board since the brightness of the displaying translucent member has a priority to all the other factors, a method is adopted, by which the number of lamps is increased. In this case, although the lamp image doesn't take place, significant increase of electric power consumption cannot be avoided.

Taking the problems described above into account, heretofore illuminating devices for large scale advertising boards are used often, in which the distance between the fluorescent lamps and the translucent member is about 30 cm and the interval of the lamps is set similarly at about 30 cm.

However, even in such a construction, the lamp image cannot be perfectly removed.

As a measure for solving the problems described above, a reflecting plate is utilized. Although it is easy to increase the brightness by using a reflecting plate, it gives rise at the same time an opposite state, where the lamp image takes place strongly, and therefore another problem remains in use thereof.

OBJECT OF THE INVENTION

The primary object of the present invention is to provide an illuminating device for a large scale advertising board, in which no lamp image is produced on an advertisement displaying translucent member while utilizing the property of a reflecting plate as it is and it is possible to obtain uniform brightness and in addition to reduce remarkably electric power consumption.

SUMMARY OF THE INVENTION

An illuminating device according to a first invention of the present application, in which a plurality of straight tube type discharge lamps are arranged in parallel with an interval and there are disposed a translucent member for advertising display in front of a row of said lamps and a reflector behind each of said lamps, is characterized in that the reflector comprises a first reflecting plate protruding in a V-shape backward to left and right so as to reflect light emitted backward from a respective lamp obliquely forward to left and right and to irradiate a central region between adjacent lamps on the translucent member; and a pair of second reflecting plates, each of which is contiguous to one end of the V-shaped first reflecting plate and reflects light emitted obliquely backward from the lamp so as to illuminate a wide region including the central region between adjacent lamps on the translucent member.

An illuminating device according to a second invention of the present application is characterized in that the reflector comprises a pair of third reflecting plates, each of which is contiguous to an end of each second reflecting plates in the first invention, which is not contiguous to the end of the V-shaped first reflecting plate, so as to reflect light emitted sideways by an adjacent lamp and to illuminate a region including the central region between adjacent lamps on the translucent member as well as a region just below the lamp.

An illuminating device according to a third invention of the present application is characterized in that the reflector comprises a pair of third reflecting plates in the first invention, each of which is contiguous to an end of each second reflecting plates, which is not contiguous to the end of the V-shaped first reflecting plate, so as to reflect light emitted obliquely backward by the lamp and to illuminate a region including the central region between adjacent lamps on the translucent member.

In an illuminating device having the construction described above, non-uniformity in the brightness on the translucent member just below the lamps and in the central region between adjacent lamps is reduced by illuminating the central region between adjacent lamps on the translucent member for advertising display, where the brightness is otherwise lowest, and thus it is possible to obtain a translucent surface, where there is no lamp image.

DETAILED DESCRIPTION

FIGS. 1 to 7 show an embodiment of the present invention.

In these figures A represents an illumination box for an advertising board, which is long in a horizontal direction. A translucent sheet a for advertising display made of polyvinyl chloride with cloth is disposed in the front of the box. In the box a number of straight tube type fluorescent lamps B are arranged parallelly to each other and a reflector C according to the present invention is disposed behind each of the lamps B.

A reflector C according to the embodiment of the present invention is composed of a V-shaped reflecting plate C1 protruding approximately symmetrically backward towards the left and the right of the lamp, which is disposed behind the center of the lamp; a pair of second reflecting plates C2, each of which is contiguous to one end of the first reflecting plate C1 and protrudes forward; and a pair of third reflecting plates, each of which is contiguous to an end of each second reflecting plates C2, which is not contiguous to the end of the V-shaped first reflecting plate C1, protruding backward.

The angle $\theta 1$ formed by the V-shaped first reflecting plate C1, the protrusion angle $\theta 2$ formed by the first reflecting plate C1 and one of the second reflecting plates C2, and the protrusion angle $\theta 3$ formed by this second reflecting plate C2 and one of the third reflecting plate C3 are obtuse in the example indicated in the figure. However these angles may be determined arbitrarily in the design, depending on the distance between the lamps and the distance between the translucent member and each of the lamps.

Figure 1:
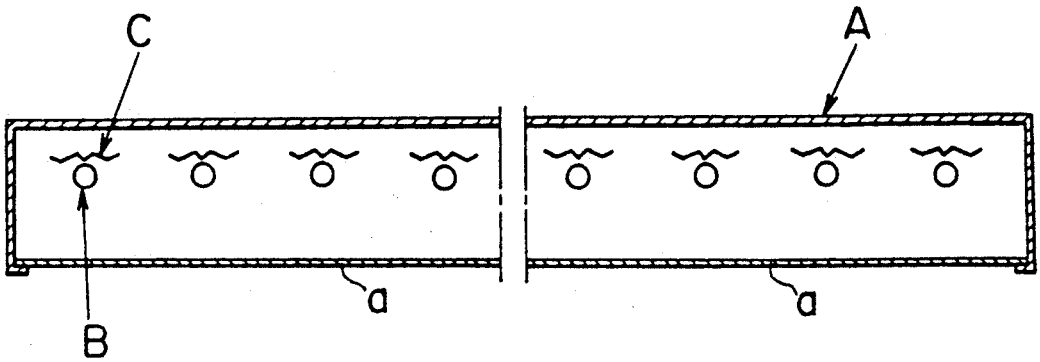
FIG. 1 is a scheme indicating the construction of an illuminating device, which is an embodiment of the present invention.
Figure 2:
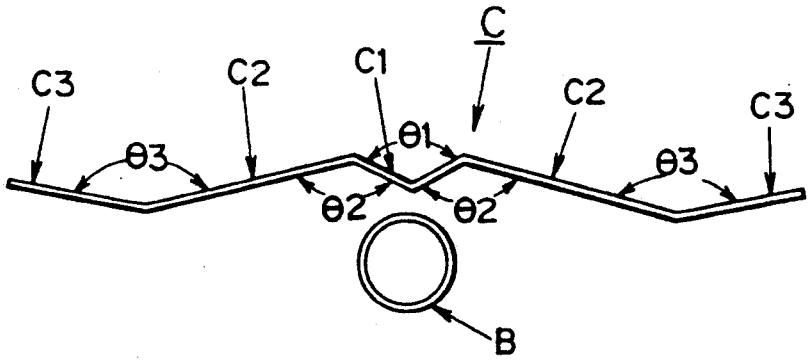
FIG. 2 is a side view of a reflector.
Figure 3:
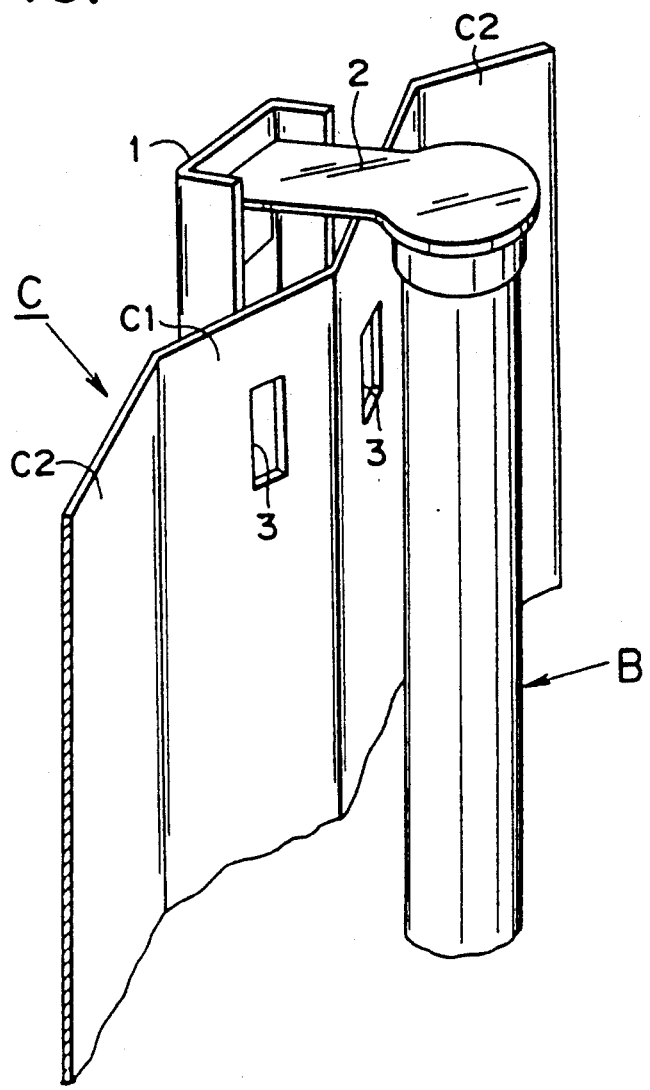
FIG. 3 is a perspective view of a reflector mounting construction.
Figure 4:
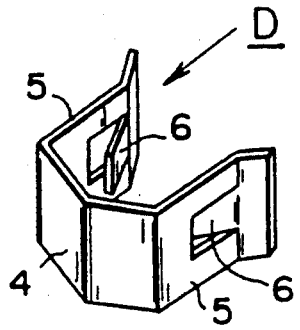
FIG. 4 is a perspective view of a mounting metal fitting.
Figure 5:
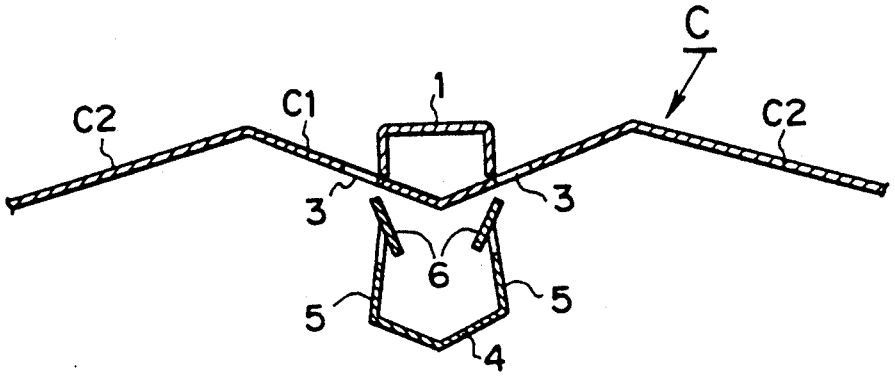
FIG. 5 is a transversal cross-sectional view of the reflector mounting construction in a state, before the mounting metal fitting is mounted on the reflector.
Figure 6:
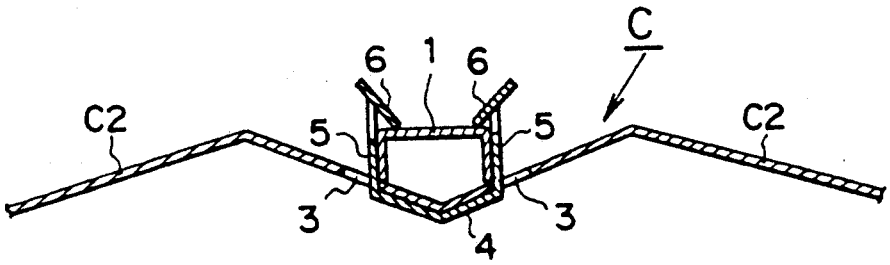
FIG. 6 is a transversal cross-sectional view of the reflector mounting construction in a state, after the mounting metal fitting has been mounted on the reflector.

An example of means for mounting the reflector C described above are indicated in FIGS. 3 to 7. Reference numeral 1 represents a channel type pillar for mounting illuminating means, which is secured to the illuminating box. One end of an arm plate 2 is fixed to each of the upper and the lower end of the pillar and a fluorescent lamp B is supported by protruding ends thereof through sockets. The reflector C is located in front of the pillar 1. Openings 3, through which reflector mounting metal fittings D are inserted, are formed in the V-shaped first reflector C1 constituting the reflector C in the neighborhood of the upper and the lower end thereof. A mounting metal fitting D is a band-shaped metal plate bent in a V-shape, composed of a front plate 4 and two side plates 5, 5. A cut and raised nail 6 protruding inward is formed on each of the side plates 5, 5. As indicated in FIGS. 5 and 6, when the side plates 5, 5 are inserted in the openings 3, 3 and slid along the side surfaces of the pillar 1, the nails 6, 6 are released after having passed through the side surfaces of the pillar 1. In this way, the reflector C is supported by the pillar by making the nails 6, 6 engage with the back surface of the pillar 1.

Figure 7:
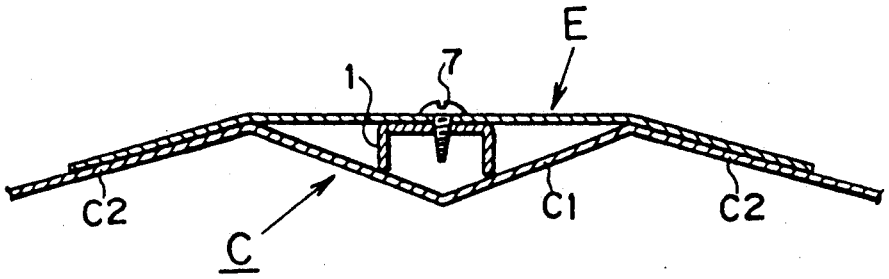
FIG. 7 is a transversal cross-sectional view of the reflector mounting construction in a state, where a backplate is applied to the reflector.

Further, as indicated in FIG. 7, a wing-shaped metal backplate E is secured to the pillar 1 at a desired position. In this way it is possible to intend to stabilize the reflector by adding means for pressing down the back surface of the reflector C by means of this metal backplate.

Figure 8:
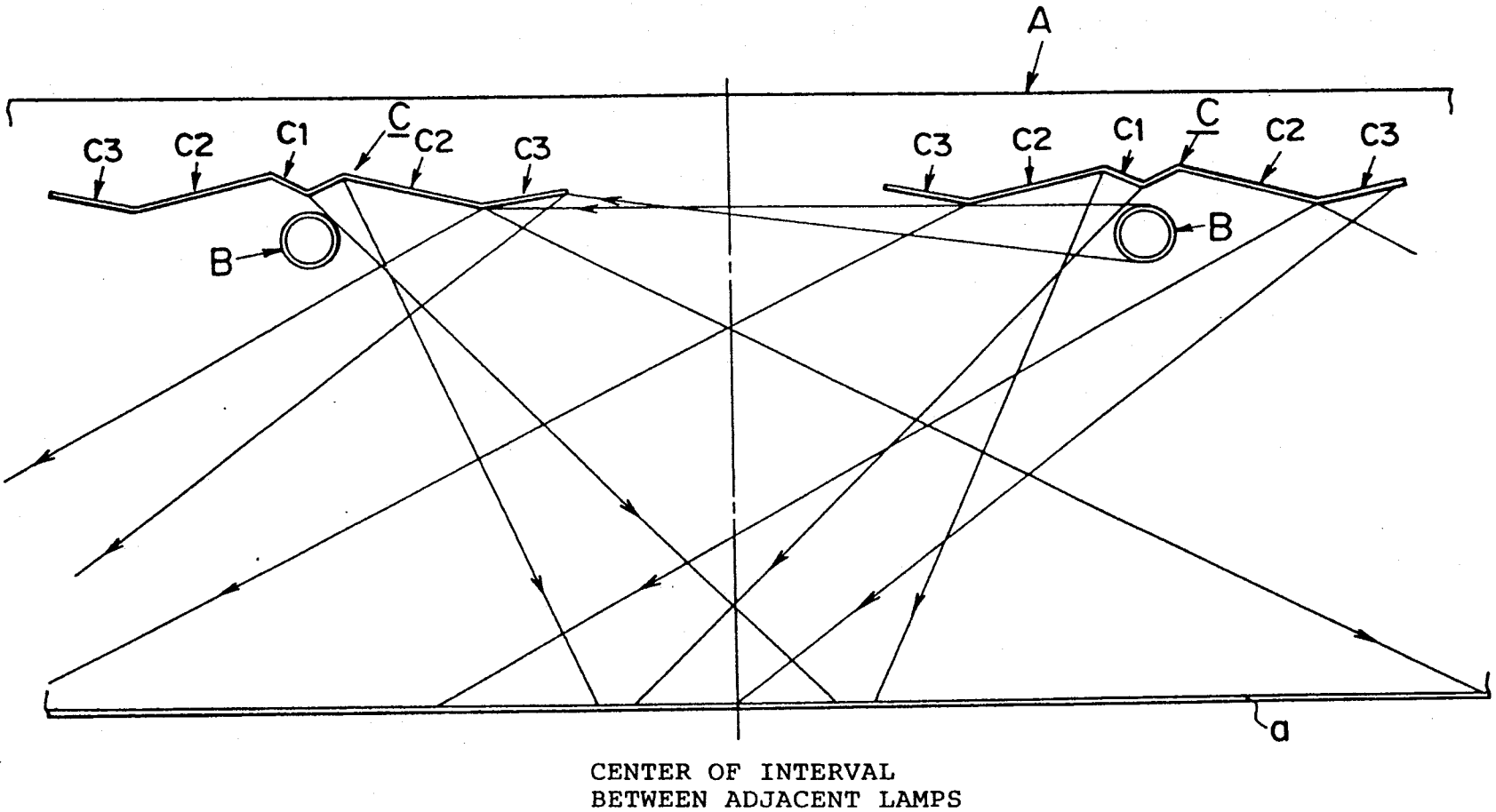
FIG. 8 is a scheme for explaining irradiation of a translucent member showing an example of illumination of an advertising board.

FIG. 8 shows an example of the illumination for an advertising board using the reflector C described above.

This example is based on a standard design for a large scale advertising illumination, in the case where the distance between a fluorescent lamp and the translucent sheet a is 30 cm and the distance between adjacent lamps is 50 cm. The angles formed by the first reflector C1, the second reflector C2 and the third reflector C3 are set in regions of $\theta 1 = 135$ to 130°, $\theta 2 = 145$ to 140° and $\theta 3 = 155$ to 150°, respectively.

In the illuminating device constructed as described above, as indicated in FIG. 8, the first reflecting plate C1 reflects light emitted backward from the obliquely forward to the left and the right so as to illuminate a central region between adjacent lamps on the transparent sheet a. Further, the second reflecting plates C2 irradiates a wide region including principally the central region between adjacent lamps as well as a region just below the lamp with light emitted obliquely backward from the lamp. Still further the third reflecting plates C3 reflects light emitted sideways by an adjacent lamp so as to illuminate a region from the central region between adjacent lamps to a region just below the lamp. The region on the translucent sheet illuminated by the first to the third reflector is indicated only schematically in order to facilitate understanding.

As described above, since the wide region on the translucent sheet a including principally the central region between adjacent lamps is irradiated with light reflected by the first to the third reflecting plates C1, C2 and C3, the lamp image disappears. In addition, it is possible also to increase brightness of the whole surface of the translucent member.

Now an experimental example, in which the illuminating device according to the embodiment described above is compared with a prior art illuminating device will be described below.

In the prior art illuminating device, in which there were arranged five rows in a horizontal direction, each of the rows consisting of 9 straight tube type fluorescent lamps of 40 W disposed in parallel with an interval of 20 cm in a vertical direction in parallel, at a position distant by 30 cm in average from the translucent sheet for advertising display having a horizontal length of 8 m and a vertical width of 2 m (area 16 $m^2$) and in addition 11 lamps were arranged in a standing state on one side thereof so that the translucent sheet was irradiated with 56 lamps in total (2240W in total), an average brightness on the surface of the translucent sheet of 900 lux was obtained.

On the other hand, in the case where 16 fluorescent lamps of 52 W (822 W in total) were arranged in the horizontal direction with an interval of 50 cm at a position distant by 30 cm from the translucent sheet and there were disposed a reflector having the construction as described above behind each of the lamps so as to irradiate the translucent sheet with reflected light, there was no lamp image and in addition it was possible to obtain a brightness of 1350 lux on the surface of the translucent sheet, which was increased by 50% with respect to that obtained by the prior art device. In this way electric power consumption could be saved by 63%.

Figure 9:
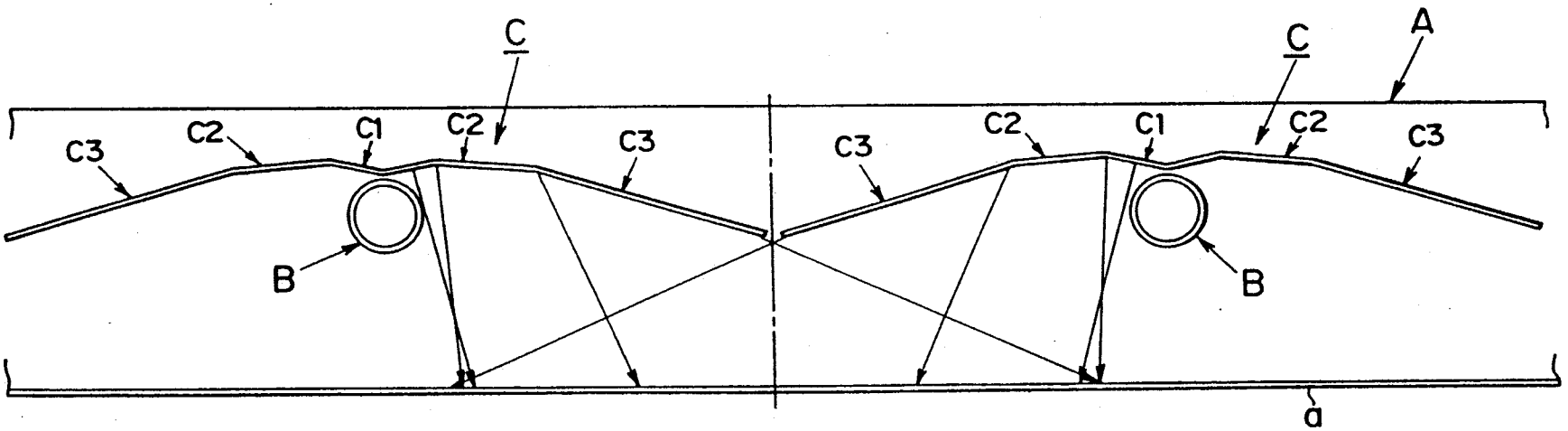
FIG. 9 is a scheme for explaining irradiation of a translucent member showing another example of illumination of an advertising board.

FIG. 9 indicates another embodiment of the present invention.

The present embodiment represents a case where the distance between the lamps and the translucent sheet is as extremely small as 6 cm. When the distance between the lamps and the translucent sheet is so small, lamp image appears strongly. In order to remove the lamp image, unless the interval between adjacent lamps is made small so that the lamps are arranged closely to each other, no effect can be obtained.

In the embodiment described above, in order to remove the problem described above, it is so constructed that the third reflecting plates contiguous to the extremities of the second reflecting plates C2 protrude inward and that the angles $\theta 1$, $\theta 2$ and $\theta 3$ and the length of each of the reflecting plates are appropriately regulated.

In the illuminating device having the construction described above, as indicated in FIG. 9, the first reflecting plate C1 illuminates the central region on the translucent sheet between different lamps; the second reflecting plates C2 illuminate the wide region including principally the central region on the sheet between adjacent lamps; and the third reflecting plates illuminate the wide region on the translucent sheet including the central region between adjacent lamps by reflecting light emitted by a lamp located at that position (called self illuminating lamp), similarly to the first and the second reflecting plates.

Now an experimental example of the illuminating device according to the embodiment described above.

A translucent sheet for advertising board having a horizontal length of 1.2 m and a vertical width of 1.2 m was illuminated with 3 straight tube type fluorescent lamps arranged parallelly with an interval of 40 cm at a position distant by 6 cm therefrom. In the case where no reflector was used, the brightness on the translucent sheet at the region just below the lamps was 2986 lux, the brightness at the central region between adjacent lamps was 950 lux, and the lamp image appeared strongly. On the other hand, in the case where the reflector described above was used, the brightness on the translucent sheet at the region just below the lamps was 3903 lux, the brightness at the central region between adjacent lamps was 4033 lux, and no lamp image was observed. Further, also in the present embodiment, an effect of substantially remarkable saving in electric power can be obtained with respect to the case where the lamp image is removed by increasing the number of lamps without using the reflectors by the prior art technique. The illuminating device in the present embodiment is suitable for a thin type advertising board mounted on a platform or a wall of a passage in a station.

Figure 10:
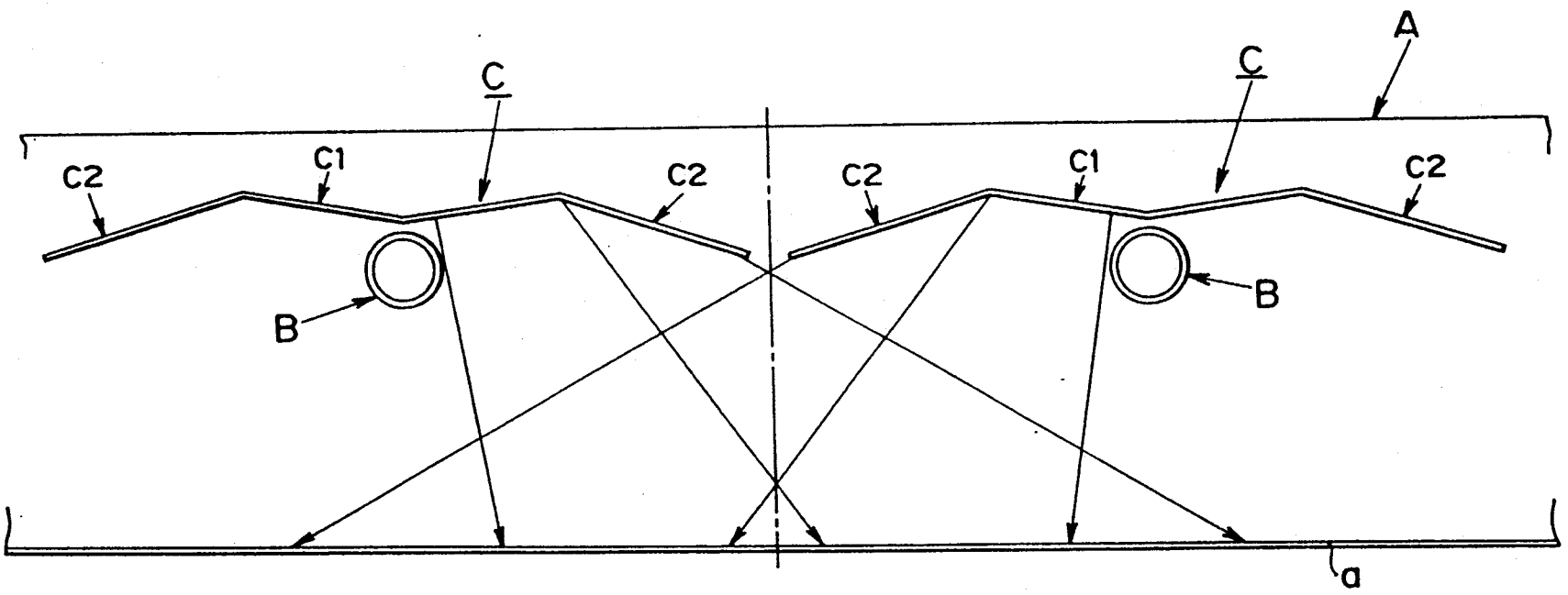
FIG. 10 is a scheme for explaining irradiation of a translucent member showing still another example of illumination of an advertising board.

FIG. 10 shows still another embodiment of the present invention.

The present embodiment represents an example, for an illuminating device for middle and short distance, for which the distance between the lamps and the translucent sheet is 11 cm, in which the reflector C is composed of the first reflecting plate C1 and the second reflecting plates C2 and the third reflecting plates are omitted.

In the illuminating device having the construction described above, as indicated in FIG. 10, the first reflecting plate C1 illuminates the central region on the translucent sheet between adjacent lamps and the second reflecting plates C2 illuminate the wide region including principally the central region between adjacent lamps.

Now an experimental example of the illuminating device according to the embodiment described above will be described.

A translucent sheet for advertising board having a horizontal length of 4 m and a vertical width of 1.3 m was irradiated with 2 straight tube type fluorescent lamps arranged parallelly with an interval of 31 cm at a position distant by 11 cm therefrom. In the case where noreflector was used, the brightness on the translucent sheet at the region just below the lamps was 787 lux, the brightness at the central region between adjacent lamps was 450 lux, and the lamp image appeared strongly. On the other hand, in the case where the reflector described above was used, the brightness on the translucent sheet at the region just below the lamps was 3006 lux, the brightness on the translucent sheet at the central region between adjacent lamps was 2940 lux, and no lamp image was observed. Further, also in the present embodiment, electric power consumption is only 80 W (2 lamps), while it is 120 W (3 lamps) for a prior art device, and therefore an electric power saving effect can be obtained.

As described above, according to the present invention, when the illuminating device is used for an advertising board, following effects can be obtained.

(1) By using a reflector having a special construction lamp image is removed and it is possible to realize remarkable increase in the brightness on the surface of a translucent member for advertising display.

(2) It is possible to reduce significantly the number of used fluorescent lamps and to reduce remarkably electric power consumption with respect to those observed for a prior art advertising board illuminating device.

(3) Control of light illuminating a translucent sheet can be set arbitrarily by varying the angles and the lengths of the first to the third reflecting plate constituting the reflector.

(4) Maintenance and check such as exchange of lamps, etc. in the space with in a box for the advertising board are easy.

(5) It is possible to reduce the weight of the whole advertising board illuminating device and fabrication cost.

What is claimed is:

1. An illuminating device, in which a plurality of straight tube type discharge lamps are arranged in parallel with an interval and there are disposed a translucent member for advertising display in front of a row and said lamps and a reflector behind each of said lamps, wherein said reflector comprises:

a first reflecting plate protruding in a V-shape backward left and right of a respective said lamp so as to reflect light emitted backward from said respective lamp obliquely forward to the left and right to illuminate a central region between adjacent lamps on said transparent member; and a pair of second reflecting plates, each of which is contiguous to one end of said V-shaped first reflecting plate and reflects light emitted obliquely backward from said lamp so as to illuminate a wide region including said central region between adjacent lamps on said translucent member;

wherein said translucent member for advertising display is composed of a sheet made of polyvinyl chloride with cloth.

2. An illuminating device according to claim 1, wherein a protrusion angle formed by any two of said plates which are contiguous to each other is obtuse.

3. An illuminating device according to claim 1, including behind said first reflecting portion of each said reflector an elongate member which extends substantially parallel to said lamps, including first and second openings provided in respective portions of said first reflecting plate which form respective sides of said V-shape, and including a U-shaped fitting having a V-shaped front portion disposed against said first reflecting plate and having two side portions which extend through respective said openings and on respective sides of said elongate member from respective ends of said front portion, each said side portion having at an end thereof remote from said front portion a bent nail portion which engages said elongate member on a side thereof remote from said reflector.

4. An illuminating device according to claim 3, wherein each said elongate member has fixedly secured thereto a backplate, each said backplate having two portions which each engage a respective said second reflecting plate of the reflector on the elongate member to which the backplate is secured.

5. An illuminating device according to claim 3, including a pair of arms which are fixedly supported at spaced locations on and project forwardly from each said elongate member, said arms each having thereon a socket and each said lamp having its ends supported by said sockets on a respective said pair of arms.

6. An illuminating device, in which a plurality of straight tube type discharge lamps are arranged in parallel with an interval and there are disposed a translucent member for advertising display in front of a row of said lamps and a reflector behind each of said lamps, wherein said reflector comprises:

a first reflecting plate protruding in a V-shape backward left and right of a respective said lamp so as to reflect light emitted backward from said respective lamp obliquely forward to the left and right to illuminate a central region between adjacent lamps on said translucent member;

a pair of second reflecting plates, each of which is contiguous to one end of said V-shaped first reflecting plate and reflects light emitted obliquely backward from said lamp so as to illuminate a wide region including said central region between adjacent lamps on said translucent member as well as a region just below said lamp; and a pair of third reflecting plates, each of which is contiguous to an end of a respective one of said second reflecting plates which is not contiguous to said end of said V-shaped first reflecting plate, so as to reflect light emitted sideways by an adjacent lamp to illuminate a region form said central region between adjacent lamps on said translucent member to a region just below said lamp.

7. An illuminating device according to claim 6, wherein a protrusion angle formed by any two of said plates which are contiguous to each other is obtuse.

8. An illuminating device according to claim 6, wherein said translucent member for advertising display is composed of a sheet made of polyvinyl chloride with cloth.

9. An illuminating device according to claim 6, wherein portions of said first reflecting plate which form respective sides of said V-shape extend at an angle in a range of 130° to 135° with respect to each other, wherein each said second reflecting plate extends at an angle in a range of 140° to 145° with respect to the end of said first reflecting plate contiguous thereto, and wherein each said third reflecting plate extends at an angle in a range of 150° to 155° with respect to the second reflecting plate contiguous thereto.

10. An illuminating device according to claim 9, wherein said lamps are each approximately 30 cm from said translucent sheet, and wherein said interval between adjacent said lamps is approximately 50 cm.

11. An illuminating device according to claim 6, including behind said first reflecting portion of each said reflector an elongate member which extends substantially parallel to said lamps, including first and second openings provided in respective portions of said first reflecting plate which form respective sides of said V-shape, and including a U-shaped fitting having a V-shaped front portion disposed against said first reflecting plate and having two side portions which extend through respective said openings and on respective sides of said elongate member from respective ends of said front portion, each said side portion having at an end thereof remote from said front portion a bent nail portion which engages said elongate member on a side thereof remote from said reflector.

12. An illuminating device according to claim 11, wherein each said elongate member has fixedly secured thereto a backplate, each said backplate having two portions which each engage a respective said second reflecting plate of the reflector on the elongate member to which the backplate is secured.

13. An illuminating device according to claim 11, including a pair of arms which are fixedly supported at spaced locations on and project forwardly from each said elongate member, said arms each having thereon a socket and each said lamp having its ends supported by said sockets on a respective said pair of arms.

14. An illuminating device, in which a plurality of straight tube type discharge lamps are arranged in parallel with an interval and there are disposed a translucent member for advertising display in front of a row of said lamps and a reflector behind each of said lamps, wherein said reflector comprises:

a first reflecting plate protruding in a V-shape backward left and right of a receptive said lamp so as to reflect light emitted backward from said respective lamp obliquely forward to the left and right to illuminate a central region between adjacent lamps on said translucent member;

a pair of second reflecting plates, each of which is contiguous to one end of said V-shaped first reflecting plate and reflects light emitted obliquely backward from said lamp so as to illuminate a wide region including said central region between adjacent lamps on said translucent member as well as a region just below said lamp; and a pair of third reflecting plates, each of which is contiguous to an end of a respective one of said second reflecting plates which is not contiguous to said end of said V-shaped first reflecting plate, so as to reflect light emitted obliquely backward by said lamp to illuminate a region including said central region between adjacent lamps on said translucent member;

wherein said translucent member for advertising display is composed of a sheet made of polyvinyl chloride with cloth.

15. An illuminating device according to claim 14, wherein a protrusion angle formed by any two of said plates which are contiguous to each other is obtuse.

16. An illuminating device according to claim 14, including behind said first reflecting portion of each said reflector an elongate member which extends substantially parallel to said lamps, including first and second openings provided in respective portions of said first reflecting plate which form respective sides of said V-shape, and including a U-shaped fitting having a V-shaped front portion disposed against said first reflecting plate and having two side portions which extend through respective said openings and on respective sides of said elongate member from respective ends of said front portion, each said side portion having at an end thereof remote from said front portion a bent nail portion which engages said elongate member on a side thereof remote from said reflector.

17. An illuminating device according to claim 16, wherein each said elongate member has fixedly secured thereto a backplate, each said backplate having two portions which each engage a respective said second reflecting plate of the reflector on the elongate member to which the backplate is secured.

18. An illuminating device according to claim 16, including a pair of arms which are fixedly supported at spaced locations on and project forwardly from each said elongate member, said arms each having thereon a socket and each said lamp having its ends supported by said sockets on a respective said pair of arms.

* * * * *

UNITED STATES PATENT AND TRADEMARK OFFICE

CERTIFICATE OF CORRECTION

PATENT NO. : 5 134 553

DATED : July 28, 1992

INVENTOR(S) : Yoshihiro HASEGAWA

It is certified that error appears in the above-identified patent and that said Letters Patent is hereby corrected as shown below:

Column 6, line 52; replace "and said lamps" with ---of said lamps---.

Column 7, line 55; replace "form said" with ---from said---.

Signed and Sealed this

Fourteenth Day of September, 1993

*Attest:*

*Attesting Officer*

BRUCE LEHMAN

*Commissioner of Patents and Trademarks*